US005258738A

United States Patent [19]

Schat

[11] Patent Number: 5,258,738

[45] Date of Patent: Nov. 2, 1993

[54] SMD-RESISTOR

[75] Inventor: Bralt R. Schat, Eindhoven, Netherlands

[73] Assignee: U.S. Philips Corporation, New York, N.Y.

[21] Appl. No.: 864,827

[22] Filed: Apr. 7, 1992

[30] Foreign Application Priority Data

Apr. 16, 1991 [EP] European Pat. Off. ..... 91200892.7

[51] Int. Cl.[5] ..... H01C 1/148

[52] U.S. Cl. ..... 338/332; 338/20; 338/307

[58] Field of Search ..... 338/332, 20, 21, 307

[56] References Cited

U.S. PATENT DOCUMENTS 4,785,276 11/1988 May ..... 338/21

5,008,646 4/1991 Hennings ..... 338/20

*Primary Examiner*—Marvin M. Lateef

*Attorney, Agent, or Firm*—Norman N. Spain

[57] ABSTRACT

An SMD-resistor includes a ceramic substrate having two main faces, two side faces and two end faces which are intergranular fracture faces, two contact layers provided on two ends of a main face adjoining the end faces, a resistive layer situated on this main face and electrically contacting both contact layers are two end contacts, covering both end faces and electrically contacting the contact layers.

6 Claims, 2 Drawing Sheets

SMD-RESISTOR

BACKGROUND OF THE INVENTION

The invention relates to a SMD-resistor which comprises a ceramic substrate having two main faces, two side faces and two end faces, and which further comprises two contact layers which are applied to two ends of a main face which adjoin the end faces, a resistive layer which is applied to this main face and electrically contacts both contact layers, as well as two end contacts which cover the end faces of the substrate and which electrically contact the contact layers. The invention also relates to a method of manufacturing SMD-resistors.

The abbreviation SMD stands for "surface mountable device". Unlike conventional resistors, SMD-resistors (also termed chip resistors) have no leads. The end contacts of SMD-resistors can be used to solder them to a so-called PCB (printed circuit board) in a relatively simple manner. By virtue of the absence of leads and the small dimensions of SMD-resistors, a high packing density of said resistors on the PCB can be achieved.

SMD-resistors corresponding to the above description are known per se from, for example, DE-PS 31.04.419. The SMD-resistor described therein comprises a ceramic substrate of alumina. Such a substrate consists of a main phase of sintered $Al_2O_3$-grains which are largely surrounded by a glass-like second phase which keeps the grains together. Contact layers of silver or silver/palladium and a resistive layer are provided on said substrate by means of screen printing. These layers may alternatively be provided by means of other metallizing processes such as sputtering or vapour deposition. The end contacts of the known SMD-resistor comprise a silver or silver/palladium layer which is provided in an immersion process. This layer is provided with a solder layer in an electroplating process. The end contacts may, however, alternatively be provided on the end faces of the substrate by means of an electroless process. In said process, aqueous solutions of Ni and Ag salts in combination with reducing agents are used to provide a thin Ni-layer on the end faces.

The known SMD-resistors have disadvantages. It has for example been found that, in particular, the bonding strength of the end contacts on the end faces of the ceramic substrate is insufficient. This disadvantage occurs in particular when the SMD-resistors are mounted on a PCB. When such a PCB is exposed to mechanical loads such as bending and/or vibrations, fracture may occur between the end contacts and the end faces of the substrate. This may bring about electric interruptions in the conductor pattern of the PCB.

SUMMARY OF THE INVENTION

One of the objects of the invention is to overcome or alleviate said disadvantages. The invention more particularly aims at providing a SMD-resistor having a substantially improved bonding of the end faces to the substrate. A further object of the invention is to provide a method of manufacturing SMD-resistors having a substantially improved bonding of the end contact to the substrate.

These and other objects are achieved by a SMD-resistor of the type mentioned in the opening paragraph, which is characterized according to the invention in that the end faces are intergranular fracture faces. Intergranular fracture faces are to be understood to mean herein fracture faces extending substantially along the grain boundaries. In the case of intragranular fracture faces, the fracture faces extend almost exclusively straight through the grains of the sintered ceramic material. Said fracture faces are formed in the manufacture of the SMD-resistors when a relatively large ceramic substrate plate is broken to form elongated strips. This will be explained in greater detail in the description of the exemplary embodiments.

The invention is also based on the insight that the bonding of end contacts to substrates of SMD-resistors will improve substantially when said substrates have intergranular fracture faces. Such substrates have a relatively rough fracture face. This is caused by the fact that the fracture faces do not extend almost exclusively straight through the sintered grains but to a considerable degree along the grain boundaries. The end contacts can be anchored more satisfactorily in such a rough surface than in a relatively smooth surface. In comparison with intragranular fracture faces, intergranular fracture faces exhibit a substantially larger number of open pores in which the end contacts can anchor.

It has been found, that the known SMD-resistors comprise substrates the end faces of which exhibit almost exclusively intragranular fracture faces. Said intragranular fracture faces are less rough because the fracture faces extend almost exclusively straight through the grains.

DETAILED DESCRIPTION OF THE INVENTION

Figure 1:
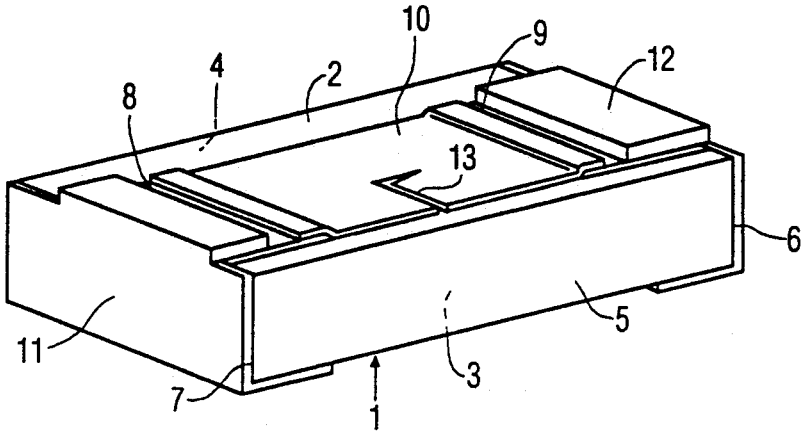
FIG. 1 is a perspective view of a SMD-resistor according to the invention.

The invention will now be described in greater detail with reference to the figures of the drawings.

A preferred embodiment of the SMD-resistor according to the invention is characterized in that the ceramic substrate is an alumina substrate comprising $SiO_2$ and MO, where M stands for Ca, Sr and/or Ba, and in that the $SiO_2$/MO-molar ratio ranges between 1 and 6.

In general, alumina substrates consist substantially, i.e. for more than 90 wt. %, of $Al_2O_3$. Alumina substrates having a $Al_2O_3$ content of approximately 96 wt. % are frequently used. Besides $Al_2O_3$, such substrates comprise as sinter additives MgO, $SiO_2$ and MO (M stands for Ca, Sr and/or Ba). M is preferably Ca. In the sintered substrates, the sinter additives are present mainly in a second phase which is situated between the sintered $Al_2O_3$ grains. The second phase may further comprise substantial quantities of $Al_2O_3$.

Experiments leading to the invention have shown that the molar ratio of $SiO_2$ and MO in the second phase is of great importance to the fracture behaviour of the ceramic substrate. When the $SiO_2$/MO-molar ratio is smaller than 1 or larger than 6, almost exclusively intragranular fracture faces are observed. This means that minimally 30% of the $Al_2O_3$ grains adjoining the fracture face are broken in the process of parting the ceramic substrate. The $SiO_2$/MO-molar ratio preferably ranges between 1.5 and 4, because at said ratio predominantly intergranular fracture faces occur. In this case, minimally 50% of the grains adjoining the fracture face are intact. At a $SiO_2$/MO-molar ratio of approximately 2, the fracture faces extend exclusively along the grain boundaries. In this case, the number of intragranularly broken grains is below 20%.

A full explanation for the surprising course of the fracture faces in the substrates of SMD-resistors is not (yet) available. It is possible that the specific $SiO_2$/MO-ratio leads to the formation of anorthite ($CaO.Al_2O_3.2SiO_2$) in the second phase. The coefficient of thermal expansion of this material differs substantially from that of alumina. This difference in coefficients of expansion could lead to hair cracks at the interface between the second phase and the sintered alumina grains. The fact that the fracture faces of alumina substrates extend along the grain boundaries could be attributable to the presence of such hair cracks.

Another advantageous embodiment of the SMD-resistor according to the invention, is characterized in that the second-phase content of the substrate is 6–10 mol %. If the second-phase content of the substrate ranges between 6 and 10 mol %, intergranular fracture faces of high quality are obtained.

The invention further relates to a method of manufacturing a SMD-resistor, in which method contact layers and resistive layers are applied to a ceramic substrate plate which is provided with a first number of parallel fracture grooves and a second number of parallel fracture grooves extending substantially perpendicularly thereto, after which the substrate plate is broken along the first number of fracture grooves to form strips which are provided with end contacts on the fracture faces formed in the breaking operation, whereupon the strips are broken along the second number of fracture grooves to form individual SMD-resistors. This method is characterized according to the invention, in that in the process of breaking the substrate plate into strips, intergranular fracture faces are formed.

A ceramic substrate plate of alumina comprising a first number of fracture grooves, the so-called strip grooves, and a second number of fracture grooves, the so-called chip grooves, is known from, inter alia, the above-mentioned German Patent Specification DE-PS 31.04.419 (see FIG. 1). As described in that Specification, the fracture grooves may be situated in one main face of the substrate plate. It is alternatively possible to use a substrate plate in which the strip grooves are provided in one main face of the plate and the chip grooves are provided in the other main face. To provide the strips with end contacts, use can be made of the immersion process described in DE-PS 31.04.419. Preferably, however, the end contacts are provided by means of a so-called electroless process. In said process, a thin Ni-layer is deposited on the fracture faces of the strips from an aqueous solution comprising Ni-salts and reducing agents. This electroless Ni-layer is made thicker by means of an electroplating process. Subsequently, a solder layer is applied to said Ni-layer. If desired, the individual SMD-resistors can be provided with a coating layer which fully covers the resistive layer. The SMD-resistors manufactured according to the inventive method have end contacts which bond well to the end faces of the substrate.

A preferred embodiment of the method according to the invention is characterized in that a ceramic alumina substrate plate is used which comprises $SiO_2$ and MO, where M stands for Ca, Sr and/or Ba, and in that the $SiO_2$/MO-molar ratio ranges between 1 and 6. A further embodiment of the inventive method is characterized in that the ceramic substrate plate comprises a second phase, and in that the second-phase content of the plate ranges from 6 to 10 mol %.

The invention will be explained in greater detail by means of exemplary embodiments and with reference to the accompanying drawing, in which FIG. 1 shows a SMD-resistor. Said resistor comprises a ceramic substrate (1) of $Al_2O_3$ which consists of two main faces (2, 3), two side faces (4, 5) and two end faces (6, 7). Two contact layers (8, 9) and one resistive layer (10) are applied to the substrate. The end faces (6, 7) are provided with end contacts (11, 12). By means of laser trimming, the resistor is adjusted to the desired resistance value. In this operation, a slit (13) is formed.

Figure 2:
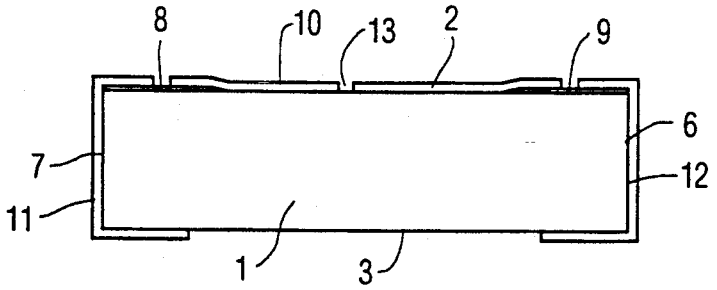
FIG. 2 is a sectional view of the SMD-resistor according to FIG. 1.

FIG. 2 shows a longitudinal sectional view of the SMD-resistor of FIG. 1, taken transversely to the main faces (2, 3) and the end faces (6, 7) of the substrate. Corresponding reference numerals in FIGS. 1 and 2 refer to the same components of the SMD-resistor.

The SMD-resistor shown in manufactured by means of thick-film techniques, the contact layers and the resistive layer being provided by means of screen printing. Similar SMD-resistors can alternatively be manufactured by means of thin-film techniques, said layers then being provided by means of sputtering or vapor deposition. In the latter case, the resistive layer and the contact layers are applied successively in a manner so that the contact layers are situated partially between the resistive layer and the substrate.

Table 1 gives the composition of the substrate for a number of different SMD-resistors. Numbers 1 up to and including 5 are exemplary embodiments according to the invention. Numbers 6 up to and including 8 are comparative examples which are not according to the invention.

TABLE 1

| No. | $AL_2O_3$ (mol. %) | $SiO_2$ (mol. %) | CaO (mol. %) | MgO (mol. %) | $SiO_2$/CaO ratio |
|---|---|---|---|---|---|
| 1 | 93 | 4.8 | 1.4 | 1.2 | 3.4 |
| 2 | 91 | 4.1 | 2.3 | 2.4 | 1.8 |
| 3 | 90 | 5.3 | 3.5 | 1.7 | 1.5 |
| 4 | 92 | 4.7 | 2.3 | 1.2 | 2.0 |
| 5 | 93 | 4.8 | 1.1 | 1.2 | 4.4 |
| 6 | 93 | 4.1 | 0.4 | 2.5 | 10.3 |
| 7 | 93 | 5.3 | 0.4 | 1.2 | 13.3 |
| 8 | 93 | 4.1 | 0.4 | 2.5 | 10.3 |

Table 2 gives the results of bending tests to which 20 specimen of each of the above-mentioned examples 1–8 were subjected. In these bending tests, finished SMD-resistors are soldered on the top side of a PCB. A pressure force was exerted in the center of the bottom side of the PCB, while the PCB is fixed at its ends. As a result thereof, the printed circuit board is bent. The values for X shown in the head of Table 2 represent the deflection (in mm) of the PCB at the location where the pressure was exerted relative to the imaginary connection line between the two points of fixation. Said points of fixation are at a distance of 90 mm from each other.

The numbers in the columns indicate how many SMD-resistors of a certain type exhibited fracture when bending increased from X−1 to X. Visual inspection of the SMD-resistors showed that fracture always occurred between the end contacts and the end faces of the substrate of the resistors.

TABLE 2

| No. | X | 1 | 2 | 3 | 4 | 5 | 6 | 7 | 8 | 9 | 10 | 11 |
|---|---|---|---|---|---|---|---|---|---|---|---|---|
| 1 | | | | | | 2 | | 18 | | | | |
| 2 | | | | | | | | | 20 | | | |
| 3 | | | | | | | | 7 | 3 | 4 | | 6 |
| 4 | | | | | | | 10 | 10 | | | | |
| 5 | | | | | 1 | 7 | 11 | 1 | | | | |
| 6 | | 2 | 3 | 15 | | | | | | | | |
| 7 | | | | 1 | 16 | 3 | | | | | | |
| 8 | | | | 4 | 9 | 7 | | | | | | |

Table 2 clearly shows that the bonding of the end contacts of the embodiments 1 up to and including 5 is much better than that of the comparative examples 6 up to and including 8. Only for the exemplary embodiments 1-5 does the $SiO_2$/CaO-molar ratio in the ceramic $Al_2O_3$ substrate range between 1 and 6.

Visual inspection showed that the fracture faces of examples 5-8 extended straight through the grains (intragranular). The fracture faces of examples 1-5 extended substantially along the grain boundaries (intergranular).

The inventive method of manufacturing SMD-resistors will be described with reference to FIGS. 3 and 4.

Figure 3A:
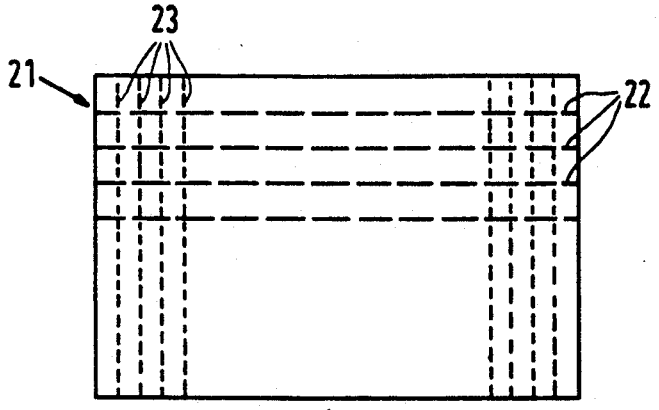
FIGS. 3*a*–3*c* are top views of a substrate plate at different stages in the method according to the invention.

FIG. 3A shows a substrate plate (21) of sintered $Al_2O_3$ having dimensions of $110\times80\times0.5$ mm$^3$. The substrate plate is provided on the bottom side with a first number of parallel, V-shaped fracture grooves (22) (strip grooves) and with a second number of parallel, V-shaped fracture grooves (23) (chip grooves). The fracture grooves (22) and (23) extend substantially perpendicularly to each other and have a depth of approximately 0.1 mm. For clarity, only a few fracture grooves are indicated with a dotted line in the FIG. 3A.

Figure 4:
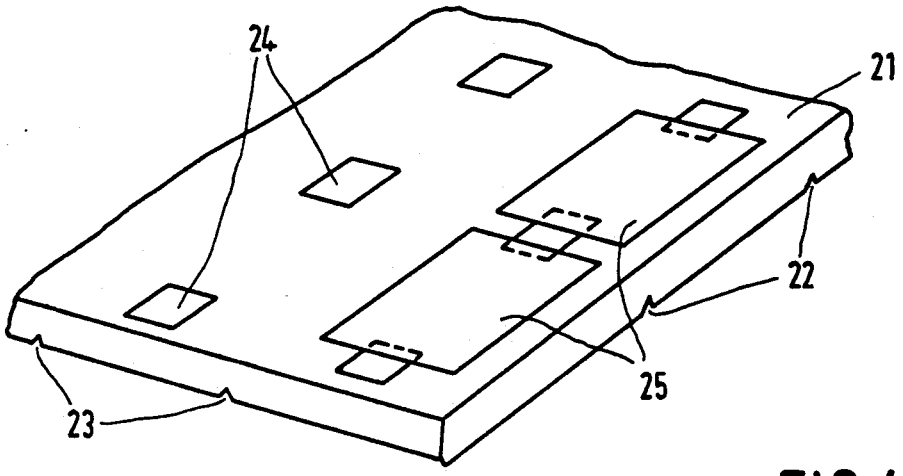
FIG. 4 is a perspective view of a part of the substrate plate used in the method according to the invention, It is noted, that for clarity the absolute and relative dimensions of the various parts in the Figures are not always represented in the correct proportions.

On the top side of the substrate plate (21) of FIG. 4, contact layers (24) are provided by means of screen printing (see FIG. 4). These contact layers, which contain for example Ag or Pd/Ag, are fired at 850° C. for 1 hour. Subsequently, resistive layers (25) are provided by means of screen printing, which layers are also fired at 850° C. for 1 hour. The resistive layers (25) partially overlap the contact layers (24). Next, the resistance value of the resistors is adjusted by means of laser trimming. If desired, a coating layer is applied to the contact layers and the resistive layers by means of screen printing. For clarity, only six contact layers and two resistive layers are shown in FIG. 4, which layers are not shown in FIG. 3A. It is noted, that the contact layers and the resistive layers may also be applied over the entire length of the substrate plate, such as is described in DE 31 04 419.

Figure 3B:
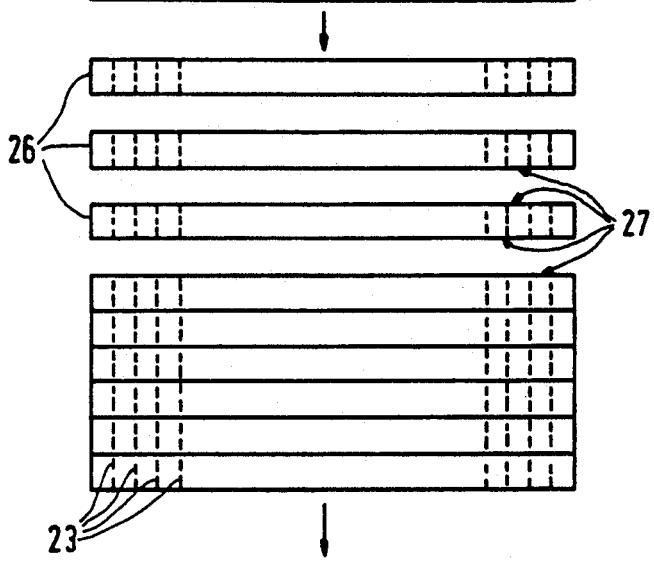
Figure 3C:
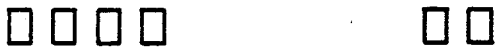

Subsequently, the substrate plate (21) is broken at the fracture grooves (22) (strip grooves) to form strips (26) (see FIG. 3B). The fracture faces (27) of the bars formed in this operation are subjected to an etching treatment using a HF solution. Next, a thin layer of Ni is deposited on the fracture faces by means of an electroless process at room temperature. Subsequently, a thicker layer of Ni is provided on said first layer by means of electroplating. Finally, to complete the formation of the end contacts (11,12), a solder layer is applied to the Ni-layers. Said end contacts (11,12) are electrically conductively connected to the contact layers (24). Finally, the strips are broken along the fracture grooves (23) (chip grooves) into individual SMD-resistors. In FIG. 3C, only a few of these resistors are (diagrammatically) shown. In total, approximately 1800 resistors having dimensions of $1.5\times3.0\times0.5$ mm$^3$ can be manufactured from said $Al_2O_3$ substrate.

Visual inspection showed that the end faces of the SMD-resistors according to the invention are intergranular fracture faces. By virtue of the roughness of said end faces, the anchoring of the end contacts in the pores of the fracture faces was improved substantially in comparison with the known resistors. By etching the fracture faces with a HF solution, the bonding strength of the end contacts to the end faces could be significantly further improved. In the etching treatment, the second phase is removed from between the alumina grains.

I claim:

1. A SMD-resistor which comprises a ceramic substrate having two main faces, two side faces and two end faces, and which further comprises two contact layers which are applied to two ends of one of said two main faces which adjoin the end faces, a resistive layer which is applied to said one main face and electrically contacts both contact layers, as well as two end contacts which cover the end faces of the substrate and which electrically contact the contact layers, characterized in that the end faces are intergranular fracture faces.

2. A SMD-resistor which comprises a ceramic substrate having two main faces, two side faces and two end faces, and which further comprises two contact layers which are applied to two ends of one of said two main faces which adjoin the end faces, a resistive layer which is applied to said one main face and electrically contacts both contact layers, as well as two end contacts which cover the end faces of the substrate and which electrically contact the contact layers, characterized in that the end faces are intergranular fracture faces, in that the ceramic substrate is an alumina substrate comprising $SiO_2$ and MO, where M stands for at least one element selected from the groups consisting of Ca, Sr and Ba and in that the $SiO_2$/Mo molar ratio is between 1 and 6.

3. A SMD-resistor as claimed in claim 2, characterized in that the second-phase content of the substrate ranges from 6 to 10 mol %.

4. A method of manufacturing a SMD resistor, said method comprising providing a ceramic substrate plate formed of a ceramic plate, which fractures to produce essentially only intergranular fracture faces, with first contact layers and resistive layers, electrically contacting first contact layers, on a main face of said plate, forming a first set of parallel fracture grooves in said plate forming a second set of parallel fracture grooves in said plastic extending substantially perpendicular to said first set of fracture grooves, fracturing said plate along said first set of fracture grooves to form bars having intergranular fracture faces, providing said fracture faces with second contact layers electrically contacting said first contact layers, and then fracturing said bars along said second set of fracture grooves to form individual SED resistors.

5. A method as claimed in claim 4, characterized in that a ceramic alumina substrate plate is used which comprises $SiO_2$ and MO, where M stands for Ca, Sr and/or Ba, and in that the of $SiO_2$/MO-molar ratio ranges between 1 and 6.

6. A method as claimed in claim 5, characterized in that the second-phase content of the plate ranges from 6 to 10 mol %.

* * * * *

UNITED STATES PATENT AND TRADEMARK OFFICE

CERTIFICATE OF CORRECTION

PATENT NO. : 5,258,738

DATED : November 2, 1993

INVENTOR(S) : Bralt R. Schat

It is certified that error appears in the above-indentified patent and that said Letters Patent is hereby corrected as shown below:

Col. 6, (claim 3) line 42, after "that the" insert --substrate comprises $Al_2O_3$ grains and a second phase in an amount such that the--.

Col. 6, (claim 4) line 49, after "ing" insert --said--.

Col. 6, (claim 4) line 52, change "plastic" to --plate--.

Col. 6, (claim 5) line 63, delete "of".

Signed and Sealed this

Twentieth Day of September, 1994

Bruce Lehman

*Attest:*

BRUCE LEHMAN

*Attesting Officer*

*Commissioner of Patents and Trademarks*